US006311685B1

(12) United States Patent
Bassoli et al.

(10) Patent No.: US 6,311,685 B1
(45) Date of Patent: Nov. 6, 2001

(54) HEAT EXCHANGER FOR OVENS FOR FOOD COOKING

(75) Inventors: Claudio Bassoli, Carpi; Alessandro Soavi, Sorbara, both of (IT)

(73) Assignee: Angelo Po Grandi Cucine S.p.A., Carpi (IT)

( * ) Notice: Subject to any disclaimer, the term of this patent is extended or adjusted under 35 U.S.C. 154(b) by 0 days.

(21) Appl. No.: 09/625,409

(22) Filed: Jul. 25, 2000

(30) Foreign Application Priority Data

Nov. 30, 1999 (IT) ..... MO99A0266

(51) Int. Cl.[7] ..... F24C 15/32

(52) U.S. Cl. ..... 126/21 A; 126/91 A; 165/125; 432/176; 432/199

(58) Field of Search ..... 126/21 R, 21 A, 126/19 R, 20, 110 R, 99 R, 110 B, 110 D, 273 R, 116 R; 432/176, 199; 165/125, 126

(56) References Cited

U.S. PATENT DOCUMENTS

| | | | | |
|---|---|---|---|---|
| 3,306,334 | * | 2/1967 | Goubsky | 126/110 B |
| 4,648,377 | * | 3/1987 | Van Camp | 126/21 A |
| 5,556,566 | * | 9/1996 | Cappello et al. | 126/21 A |
| 5,636,622 | * | 6/1997 | Urcelay Amondarain et al. | 126/21 R |
| 5,915,372 | * | 6/1999 | Wiedemann et al. | 126/21 A |

FOREIGN PATENT DOCUMENTS

| | | | | |
|---|---|---|---|---|
| 526768-A | * | 2/1993 | (EP) | 126/21 A |

* cited by examiner

*Primary Examiner*—James C. Yeung
(74) *Attorney, Agent, or Firm*—Browdy and Neimark

(57) ABSTRACT

The heat exchanger is particularly for ovens for food cooking comprising a radial fan, and is associated with a burner supplied by a blower. The heat exchanger has a first part of pipe into which the combustion gases are made to flow, which makes an almost-complete circuit of the radial fan before bifurcating into at least two pipes which extend around the radial fan.

12 Claims, 3 Drawing Sheets

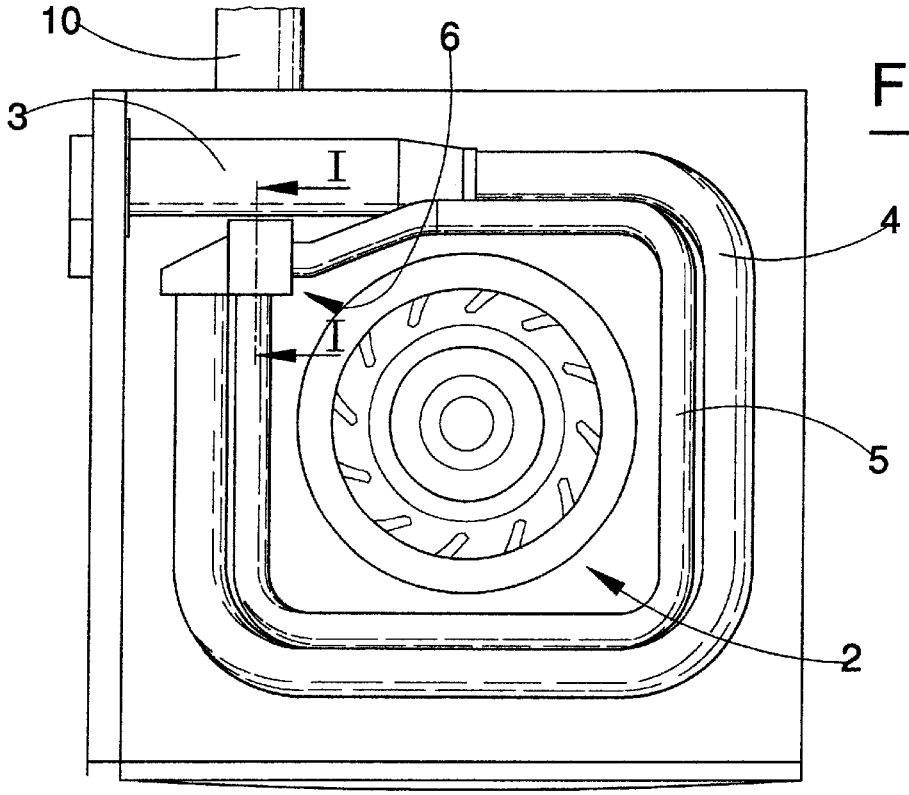
Fig. 3
Fig. 4
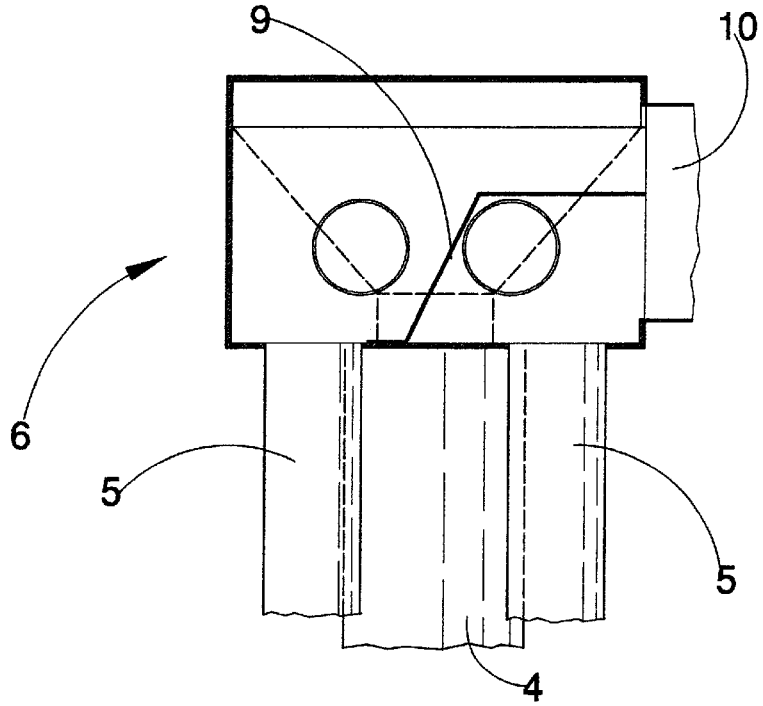

HEAT EXCHANGER FOR OVENS FOR FOOD COOKING

BACKGROUND OF THE INVENTION

The heat exchanger of the invention is of the type which surrounds a radial fan which causes the vector fluid (for example air or air and steam) to circulate and is supplied with hot gases produced by combustion of a burner.

Heat exchangers of this type are known and are constituted by a pipe, spiral-wound about the radial fan and preferably provided with internal elements which cause the fluid to spin, creating a turbulence which increases heat exchange. A burner is predisposed at one end of the pipe and is equipped with a blower to convey the hot combustion gases into the pipe. The other end of the pipe discharges directly to the environment or into a chimney flue.

Another known device, illustrated in European publication EP 0 856 705, teaches a heater constituted by a pipe, internally of which the hot gases produced by a burner flow, which pipe surrounds the fan without but not in a spiral; it is instead bent to give rise to two branches arranged side-by-side and parallel, and united by a 360° free curve. This free curve absorbs heat expansion factors, so that the points where the pipe is fixed do not suffer these effects.

The above prior art realisations, however, exhibit numerous drawbacks and limitations.

One limitation is constituted by the fact that the arrangement of the pipes around the fan does not guarantee complete and sufficiently uniform coverage of the most-ventilated zone situated peripherally about the fan. This has a negative effect on the heat exchange efficiency.

Other limitations derive from the existence of a non-eptimal thermal exchange situation internally of the pipes.

The main aim of the present invention is to obviate the above-mentioned drawbacks in the prior art.

SUMMARY OF THE INVENTION.

An advantage of the invention consists in the fact that it provides very good heat exchange efficiency, obviating the need to apply means for increasing the heat exchange which would lead to constructional complications rendering good cleaning of the device very difficult if not impossible.

A further advantage of the invention is that thanks to the efficiency of the heat exchange obtained in proximity of the fan, the vaporisition of the water (in the case of mixed ovens, with direct steam-production) occurs directly on the pipes instead of by means of additional means. This is more economical and favours uniformity of distribution of steam and temperatures internally of the cooking chamber in which the exchanger is installed.

A further advantage of the invention is that the burnier is located in a closed cage internally of the combustion chamber, which in turn is located in the cooking chamber. This arrangement is very safe because should the gas supply malfunction, or the burner itself, risk of gas escape is nil, as the gas supply circuit to the combustion chamber represents a single and completely sealed entity.

A still further advantage arises from the use of a burner of a type where the mixing of the air and the fuel is done in three successive stages, producing a very long flame which projects well into the pipe itself These aims and advantages and others besides are all attained by the invention as it is characterised in the appended claims.

BRIEF DESCRIPTION OF THE DRAWINGS.

Further characteristics and advantages of the present invention will better emerge from the detailed description that follows of some preferred but nonexclusive embodiments of the invention, illustrated purely by way of non-limiting examples in the accompanying figures of the drawings, in which:

FIG. 3 is a schematic frontal view;

FIG. 4 shows an enlarged-scale view of a detail of FIG. 3, sectioned according to line 1—1 of FIG. 3;

DESCRIPTION OF THE PREFERRED EMBODIMENTS

Figure 1:
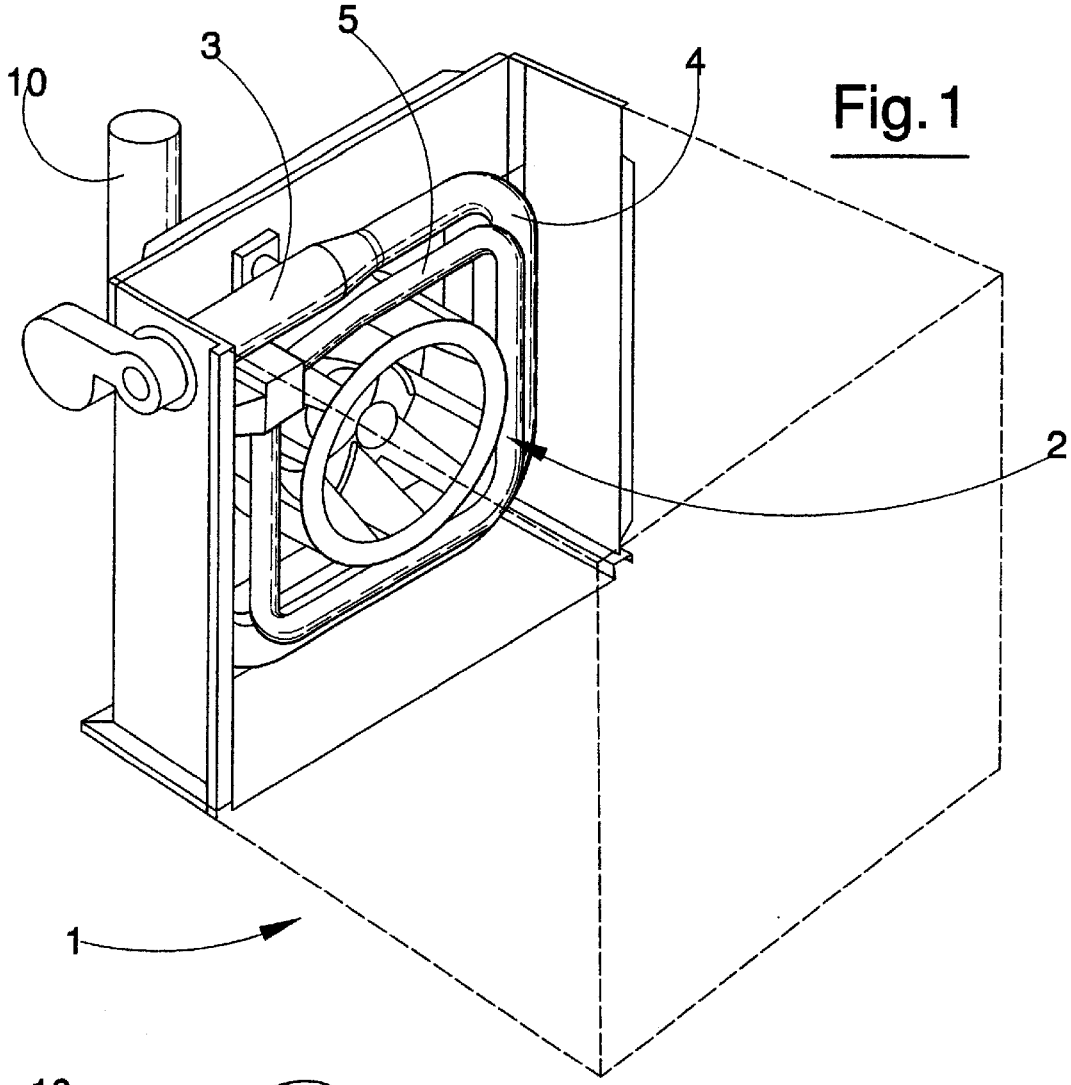
FIG. 1 is a schematic perspective view of the invention.
Figure 2:
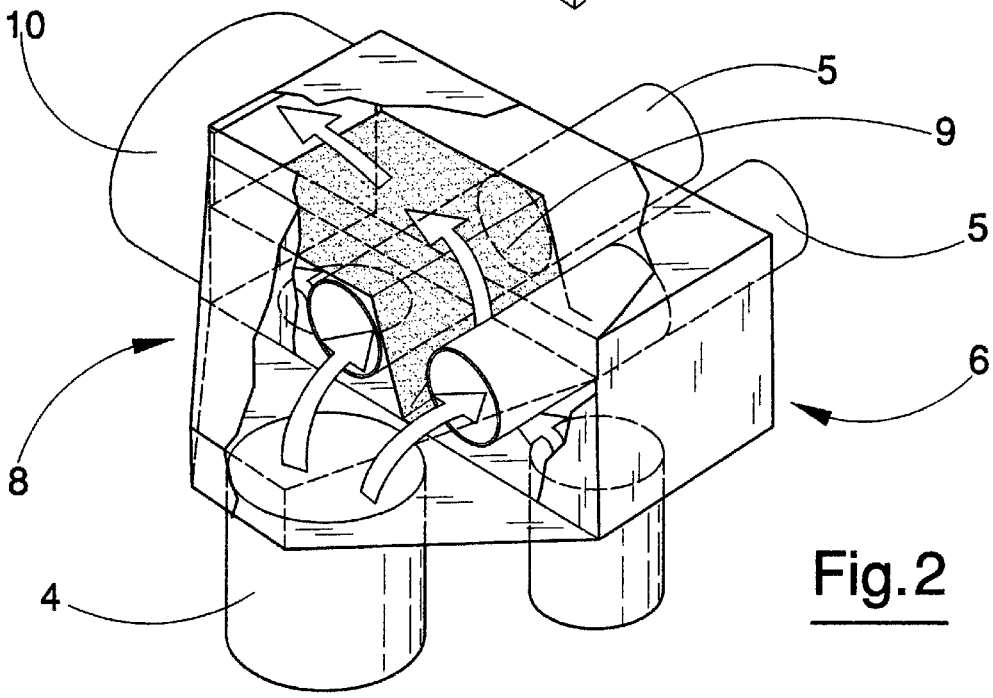
FIG. 2 is an enlarged-scale partially-sectioned detail of FIG. 1.

With reference to the figures of the drawings, 1 denotes in its entirety the cooking chamber of a food-cooking oven in which a heat exchanger device is installed. The heat exchanger surrounds a radial fan 2 and is associated to a burner 3 supplied by a blower.

The burner 3 is inside the combustion chamber which in turn is located in the cooking chamber 1. The above-mentioned combustion chamber is schematically subdivided into two parts by the presence of a diaphragm for regulating the inflow of air needed for combustion. The gas infeed and the combustion air are supplied upstream of the diaphragm through two separate circuits, while mixing of the two is done downstream thereof.

Should there be a malfunctioning of the flame-detecting safety device, the arrangement of the above-described components is nonetheless very safe, as even in the most difficult situations the gas mix cannot exit to outside the combustion chamber upstream of the diaphragm, but can only escape through the pipes 5 connected to the evacuation system.

The burner is preferably of the type where the mixing of the air and fuel is done in three successive stages, producing a very long flame which projects well into the pipes of the exchanger.

The heat exchanger comprises a first part of pipe 4, into which the combustion gases flow, which, after completing a circuit around the fan 2, bifurcates into at least two pipes 5 which extend around the fan 2 with respective axes lying in parallel planes to the plane containing the axis of the first part of pipe 4. The parallel planes containing the axes of the pipes 5 and the axis of the first part of pipe 4 are perpendicular to the axis of rotation of the radial fan 2. The pipes 5 are arranged so that they completely surround the radial fan 2. The terminal parts of the pipes 5 open into a manifold 6 which is in fact a chamber passed through by the initial parts of the pipes 5 themselves. The manifold 6 communicates directly with a discharge 10 by means of which the combustion fumes are expelled after having rendered a substantial part of their heat energy.

The first part of the pipe 4 bifurcates into the two pipe 5 through a connecting chamber 8 contiguous to the manifold 6 chamber.

The manifold 6 chamber is divided by a dividing wall 9 which has the task of keeping the exiting flow of exhaust from the pipes 5 separate up until the moment of discharge.

In the illustrated embodiment the manifold 6 and the chamber it describes are parellelepiped in shape.

The burner 3 is preferably of the type where the air and combustion fuel mixture is done in three stages, producing a very long flame which projects well into the first part of the pipe 4, thus improving heat exchange values.

The internal sections at any point in the first part of the pipe 4 and the two pipes 5 are completely free, i.e. they do not have any obstruction elements to cause combustion fuel turbulence with the aim of improving surrendering of heat therein.

The external surfaces of the first part of pipe 4 and the two pipes 5 are smooth. The bifurcation at the connection chamber 8 breaks up smooth laminar flow of the gas current, thus improving heat exchange and therefore the efficiency of the heat exchanger.

These conditions, together with the complete and regular covering of the more ventilated peripheral zone, enable better heat exchange conditions to be achieved, combining a greater overall exchanger efficiency with a considerable constructional simplification (smooth pipes), which makes the device much more advantageous both in terms of being much easier to clean and (with reference to mixed-type ovens directly producing stream) in terms of enabling vaporisation to be carried out directly on the external surfaces of the pipes, with no need for additional means to achieve this effect.

In a further embodiment of the invention, not illustrated in the figures of the drawings, the manifold in which the part of pipe 4 meets the part of pipe 5 is constituted by two physically separate chambers; a first realising the bifurcation of the part of pipe 4 into the two pipes 5; a second causing the combustion gases to flow together into the single discharge. The shape of these two half-chambers is not necessarily parellelepiped.

Figure 5:
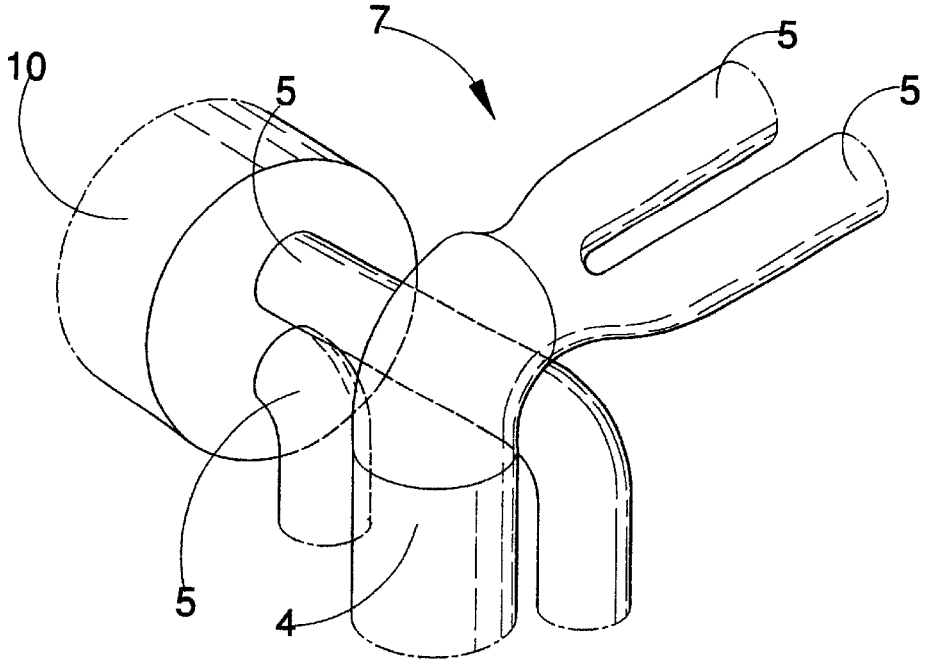
FIG. 5 is the same detail as in FIG. 2, but relating to a further embodiment of the invention.

A further possible embodiment, illustrated in FIG. 5, includes a Y-connection 7 between the part of pipe 4 and the pipes 5, which Y-connection forms the bifurcation, downstream of which the pipes 5 reach the discharge 10 separately.

Figure 6:
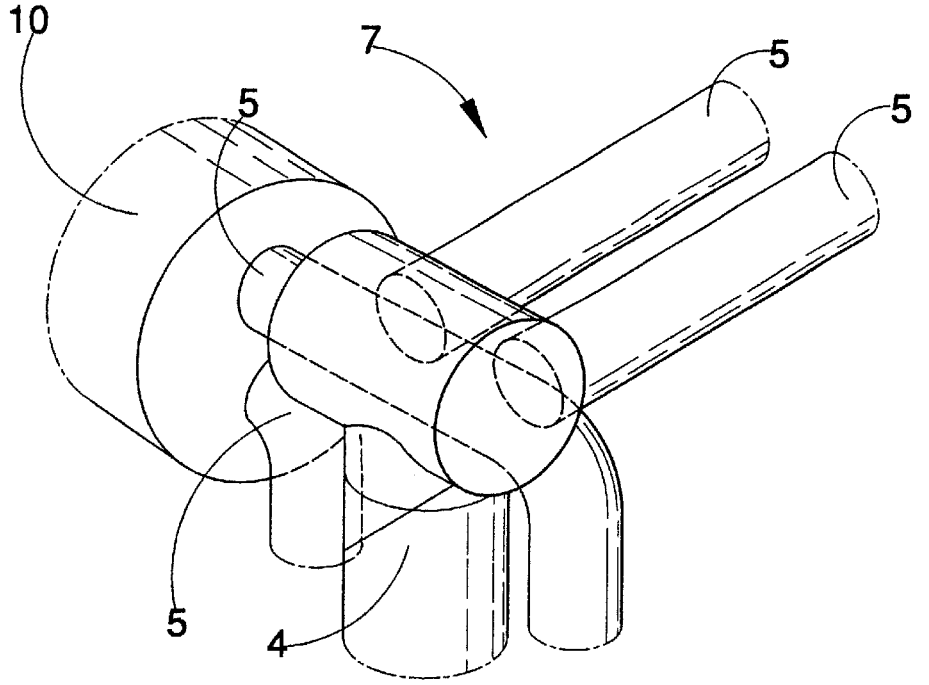
FIG. 6 is the same detail as in FIG. 2, but relating to a further embodiment of the invention.

In a further embodiment, illustrated in FIG. 6, a T-connection is included between the pipe 4 and the pipes 5, which T-connection forms the bifurcation, downstream of which the pipes 5 reach the discharge 10 separately.

What is claimed is:

1. A heat exchanger for ovens for food cooking, in which the heat exchanger surrounds a radial fan and is engaged to a burner supplied by a blower; the heat exchanger comprising a first part of pipe into which combustion gases flow formed in a single direction around the radial fan and bifurcating into at least two pipes which extend in the single direction around the radial fan;

wherein the at least two pipes extend around the radial fan and axes of the at least two pipes lie in parallel planes to a plane containing an axis of the first part of pipe;

wherein the parallel planes containing the axes of the at least two pipes and the axis of the first part of pipe are perpendicular to an axis of rotation of the radial fan;

wherein the at least two pipes substantially surround the radial fan;

wherein terminal parts of the at least two pipes open into a manifold having a chamber through which initial parts of the at least two pipes pass; the manifold leading directly to a discharge; and wherein the manifold and the chamber of the manifold are parallelepiped in shape.

2. The heat exchanger of claim 1, wherein the first part of pipe bifurcates to become the at least two pipes in a connection chamber which is contiguous to the chamber of the manifold.

3. The heat exchanger of claim 2, wherein the chamber of the manifold is divided by a dividing wall which maintains exiting flows of exhaust emanating from the at least two pipes separate up until discharge.

4. The heat exchanger of claim 1, wherein the first part of pipe bifurcates into the at least two pipes extending around the radial fan by means of a Y-connection.

5. The heat exchange(r of claim 1, wherein the first part of pipe bifurcates into the at least two pipes extending around the radial fan by means of a T-connection.

6. The heat exchanger of claim 5, wherein the at least two pipes reach the discharge separately.

7. The heat exchanger of claim 6, wherein the burner is of a type which projects a flame a considerable distance.

8. The heat exchanger claim 6, wherein the first part of pipe and the at least two pipes have smooth external surfaces.

9. The heat exchanger of claim 6, wherein internal sections of passage of the first part of pipe and the at least two pipes are completely free of obstructions.

10. The heat exchanger of claim 1, wherein the burner is of a type which projects a flame a considerable distance.

11. The heat exchanger of claim 1, wherein the first part of pipe and the at least two pipes have smooth external surfaces.

12. The heat exchanger of claim 1, wherein internal sections of passage of the first part of pipe and the at least two pipes are completely free of obstructions.

* * * * *